United States Patent [19]

Everhart

[11] 4,431,080

[45] Feb. 14, 1984

[54] AUCTIONEER'S PODIUM ASSEMBLY

[76] Inventor: James E. Everhart, 148 E. Hill St., Long Beach, Calif. 90806

[21] Appl. No.: 276,017

[22] Filed: Jun. 22, 1981

[51] Int. Cl.[3] ..... A47B 83/00

[52] U.S. Cl. ..... 182/15; 182/33.6; 182/35; 312/235 R; D6/155

[58] Field of Search ..... 182/17, 129, 33.6, 33.5, 182/33, 15, 35; 312/258, 259, 235 R, 237, 257 R, 257 SK; D6/2, 4, 155, 40

[56] References Cited

U.S. PATENT DOCUMENTS

| | | | |
|---|---|---|---|
| 190,027 | 4/1877 | Groffette | 182/33.2 |
| D. 203,545 | 1/1966 | Nordmark | D6/155 |
| 1,258,640 | 3/1918 | Abramson | 312/235 R |
| 1,596,909 | 8/1926 | Weeks | 182/33.6 |
| 3,120,410 | 2/1964 | Berg | 312/235 R |
| 4,087,144 | 5/1978 | Wax | 312/258 |
| 4,135,604 | 1/1979 | Ryan | 182/129 |
| 4,236,460 | 12/1980 | Poupko | 312/258 |

FOREIGN PATENT DOCUMENTS

| | | | |
|---|---|---|---|
| 249714 | 12/1962 | Australia | 182/15 |
| 282040 | 4/1952 | Switzerland | 182/33.6 |

*Primary Examiner*—R. P. Machado
*Assistant Examiner*—Alvin C. Chin-Shue
*Attorney, Agent, or Firm*—William C. Babcock

[57] ABSTRACT

A portable auctioneer's podium assembly movably supported on casters that may occupy either a first or second position, which assembly when in the first is defined by a vertically disposable elongate structure that supports a shelf on which the auctioneer may rest papers and the like, and an elevated platform rearwardly of the structure on which the auctioneer may stand to look down on a crowd to spot bidders. The platform is hingedly connected to the structure and may be pivoted into the latter when the assembly is disposed in a second position to occupy less space than in the first position to facilitate the transportation of the assembly from one auction site to another. Fastening means are provided to removably secure the platform in the second position.

1 Claim, 6 Drawing Figures

AUCTIONEER'S PODIUM ASSEMBLY

BACKGROUND OF THE INVENTION

1. Field of the Invention

Auctioneers Podium Assembly

2. Description of the Prior Art

In the auction of heavy objects it is more convenient for the auctioneer to leave them in place, and the auctioneer move to a position adjacent thereto. This procedure has the disadvantage that for the auctioneer to be at an elevated position above the crowd to see the bidders an improvised elevated support must be provided for him to stand on. Also, when an auctioneer so moves from place to place he has no shelf or support to rest papers and other accessories needed in conducting the auction.

A major object of the present invention is to provide a movable auctioneer's podium that is capable of occupying either a first or second position, with the podium when in a first position capable of being moved from place to place at an auction to provide an elevated platform on which the auctioneer may stand to look down on the crowd, as well as providing an elevated shelf on which the auctioneer may rest papers and the like, and after the auction is completed, the platform may be pivoted to a position within the podium structure, with the podium structure then occupying a second position where it occupies less space than in the first position, and rendering the podium structure more convenient to transport to another auction site. The platform when the podium structure is in the second position is removably locked within the interior thereof.

SUMMARY OF THE INVENTION

A portable multi-position auctioneer's podium assembly which when in a first position may be moved from place to place when casters that form a part thereof are resting on a relatively smooth floor or ground surface. The assembly when in the first position includes a vertically disposed elongate podium structure that has an elevated shelf as a part thereof on which the auctioneer may rest papers and other accessories needed in carrying out an auction.

An elevated horizontal platform is disposed rearwardly of the podium structure when the latter is in a first position. The auctioneer when standing on the platform is supported at a sufficiently high elevation above the crowd that he may look down thereon and spot bidders as the auction proceeds.

After the auction is completed, the platform that is hingedly connected to the podium structure is pivoted to the interior of the latter, and the podium structure then occupying a second position. The podium assembly when in the second position is more compact than when in the first position, and accordingly the podium assembly when in the second position is more convenient to transport from one auction site to another. The platform when disposed within the interior of the podium structure is removably locked therein to prevent it inadvertently pivoting outwardly from the structure during the time that the assembly is being transported from one auction site to another. The podium assembly above described is more convenient for an auctioneer to use, in that the podium assembly may be moved in a room from place to place as the auction proceeds, rather than the auctioneer being located in a fixed position and relatively heavy objects being required to be transported to him as they come up for auction.

DESCRIPTION OF THE PREFERRED EMBODIMENT

Figure 1:
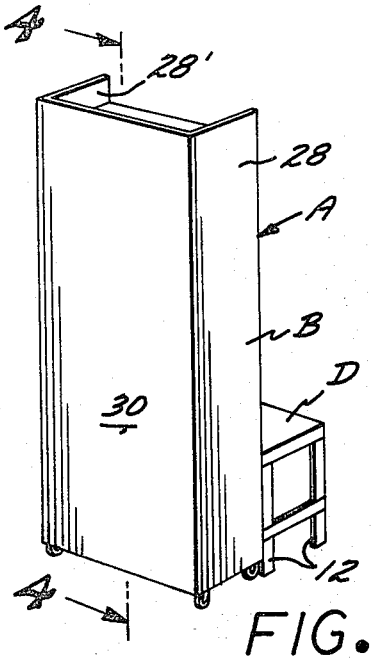
FIG. 1 is a perspective view of the podium assembly in a first position, with the assembly including an elevated horizontal shelf on which the auctioneer may rest papers and the like, and also a rearwardly disposed elevated horizontal platform on which the auctioneer may stand to be in a position to look down upon the crowd to spot possible bidders.
Figure 2:
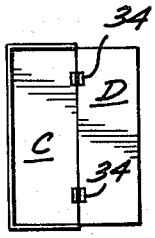
FIG. 2 is a top plan view of the podium assembly in the first position.
Figure 3:
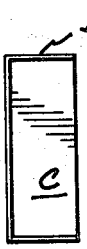
FIG. 3 is a top plan view of the podium assembly in a second position.
Figure 6:
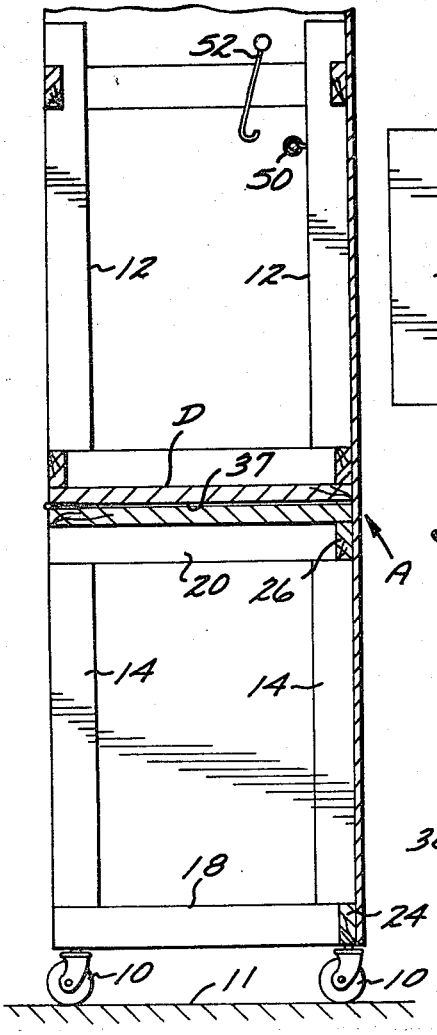
FIG. 6 is the same view as shown in FIG. 4, but with the platform being pivoted into the interior of the podium structure to occupy an inverted position, and the podium structure and platform cooperating to provide a podium assembly that is compact and may be easily transported from one auction site to another.

A multi-position movable auctioneer's podium assembly A is shown in perspective in FIG. 1 in a first position in which it is used for auctioneering purposes, and in a second position in FIG. 6 in which the podium assembly is more compact than when in the first position, and accordingly is easily and conveniently transported from one auction site to another. The podium assembly A as may be seen in the drawings includes a vertically positionable elongate box like structure B that is open at the rear, with the structure B supporting a horizontal shelf C adjacent the top thereof, which shelf may be used by an auctioneer (not shown) to rest papers and other accessories needed by him in carrying out an auction. The elongate structure B as may be seen in FIGS. 1, 4 and 6 is supported on casters 10, and as such is movable from place to place on a substantially level floor or ground surface 11.

Figure 4:
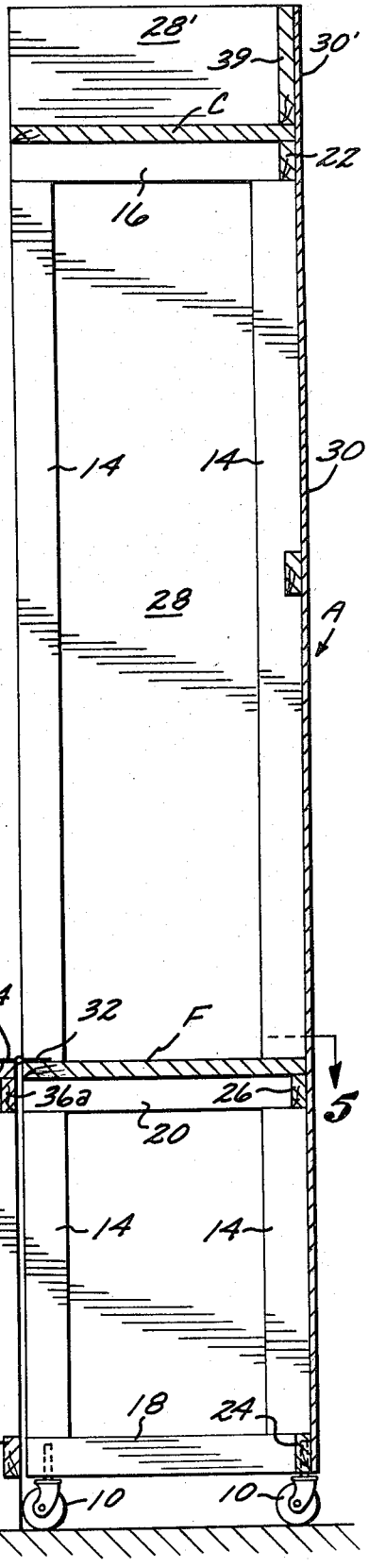
FIG. 4 is a combined side elevational and vertical longitudinal cross sectional view of the podium assembly in a first position taken on the line 4—4 of FIG. 1.

In FIGS. 1 and 4 it will be seen that the podium assembly A when in a first position has a horizontal platform D extending rearwardly therefrom, which platform is pivotally connected by hinges E to the structure B. The platform is supported at a substantial elevation above the floor surface level by legs 12 that extend downwardly therefrom. The auctioneer (not shown) when standing on the platform D is at an elevated position relative to the crowd (not shown) surrounding the podium assembly A, and may accordingly look downwardly on the crowd to spot bidders as the auction proceeds.

Figure 5:
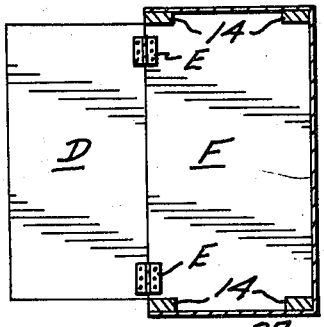
FIG. 5 is a transverse cross sectional view of the podium assembly in a first position and taken on the lines 5—5 of FIG. 4.

The vertically positionable elongate structure B as may best be seen in FIGS. 4, 5 and 6 is defined by four rigid uprights 14 that are disposed in aligned pairs. The uprights 14 are joined by a laterally spaced upper pair of reinforcing side members 16, a lower horizontal pair of reinforcing side members 18, and an intermediate pair of reinforcing side members 20. The reinforcing pairs of side members 16, 18, and 20 are joined by forwardly disposed upper, lower and intermediate cross members 22, 24 and 26.

The uprights 14 as best seen in FIGS. 4 and 5 have a pair of laterally spaced rectangular side panels 28 secured thereto, have the forward edges of the side panels being joined by a front panel 30. The pair of side panels 28 and front panel 30 extend upwardly from the lower pair of reinforcing side members 18 and lower cross member 24 to a position above the shelf C as shown in FIG. 4, with the portions of the panels 28 and front panel 30 disposed above the shelf being identified by the numerals 28' and 30' to provide wall sections about the shelf C to prevent papers and other auctioneer's paraphernalia from inadvertantly being displaced from the shelf during the auction. The intermediate reinforcing members 20 and front intermediate cross member 26 support a horizontal floor F that in combination with the shelf C serves to laterally reinforce the elongate structure B.

A pair of laterally spaced piano type hinges E are provided that have first hinge portions 32 and second hinge portions 34. The first hinge portions 32 as may be seen in FIG. 4 are secured by screws or the like to the rearward portion of the floor F. The platform D as may be seen in FIG. 4 has the second hinge portions 34 secured to the upper forward portion thereof, with the platform being secured to a rectangular frame 36 that is defined by a pair of end pieces **36*a* and side pieces 36*b* as shown in FIG. 4. The platform D and the frame 36 have four legs 12 extending downwardly therefrom with the height of the legs being such that when the lower ends are resting on the floor or ground surface 11, the platform D is supported in a substantially horizontal position. The lower portion of the legs 12 are reinforced by a second rectangular frame 38 that has end pieces 38*a* and side pieces 38*b* that are joined to one another and to the legs 12**.

In FIG. 5 it will be noted that the floor F has the corners thereof recessed, and the uprights 14 being disposed in these recesses. The width of the platform D is such that when an auction is completed, the platform and the supporting legs 12 may be pivoted substantially 180° as shown in FIG. 6, for the upper surface 37 of the platform to rest on the floor D and the legs 12 extending upwardly therefrom. The assembly A is now in a second position as shown in FIG. 6 that is more compact than in the first position, and permits the podium assembly A to be more easily transported from one auction site to another.

Each of the rearwardly disposed legs 12 as may be seen in FIG. 4 supports a forwardly extending eye defining bolt 50, which eye bolt may be engaged by a swivel supported hook 52 or other fastening means as shown in FIG. 6 to support the platform removably within the podium structure A when the podium assembly is in the second position illustrated in FIG. 6.

The forward panel portion 30' is reinforced with a transverse member 39 of substantially the same height. The podium structure A may in the main be fabricated from wood, although other rigid materials either of a metallic or non-metallic nature may be used for this purpose if desired.

The use and operation of the invention has been described previously in detail and need not be repeated.

What is claimed is:

1. A portable auctioneers podium that includes:

a. an elongate vertically disposed box like assembly that includes a rigid frame that supports a front panel and a pair of side panels, said frame at an elevated position thereon supporting a floor member having a rear edge portion and at a position adjacent the top of said frame a substantially horizontal desk surface defining member, and said assembly including a plurality of casters that movably support said assembly and permit the latter to be moved from location to location at an auction;

b. a platform of less width than that of the interior of said frame, said platform including a forward and a rear edge portion;

c. piano hinge means that pivotally connect said forward edge portion of said platform to said rear edge portion of said floor member; and d. a plurality of legs secured to said platform at said forward and rear edge portion said legs of such length that when said platform is pivoted to a first position where it extends rearwardly from said assembly said legs contact the surface on which said assembly rests and support said platform at a substantially horizontal position, upon which an auctioneer can stand, and the weight of the auctioneer when so standing forcing said legs into frictional engagement with said supporting surface to the extent said assembly cannot be inadvertently moved relative thereto, and said platform capable of being pivoted to a second position where it is disposed within said assembly and rests on said floor member with said legs extending upwardly from the latter, and in which said second position said podium occupies a minimum of space and may be transported in a vehicle from one auction site to another.

* * * * *